United States Patent [19]

Uchida et al.

[11] Patent Number: 4,854,452

[45] Date of Patent: Aug. 8, 1989

[54] BILL RECEIVING, DISCRIMINATING, AND DISPENSING MACHINE

[75] Inventors: Shinya Uchida, Chigasaki; Akira Hirata, Kawagoe; Hideyuki Ebihara, Tokyo; Eiichi Yoshikawa, Hasuda; Eisaku Sano; Kazuhiro Uehara, both of Tokyo, all of Japan

[73] Assignee: Laurel Bank Machines Co., Ltd., Tokyo, Japan

[21] Appl. No.: 113,237

[22] Filed: Oct. 27, 1987

[30] Foreign Application Priority Data

Oct. 27, 1986 [JP] Japan ..... 61-255441

[51] Int. Cl.[4] ..... B07C 5/34

[52] U.S. Cl. ..... 209/534; 194/206; 271/3.1; 271/187; 271/315; 271/308; 235/379

[58] Field of Search ..... 194/206, 207; 271/3.1, 271/3, 178, 187, 314, 315, 306, 307, 308, 214, 213; 209/534; 235/379, 380, 381

[56] References Cited

U.S. PATENT DOCUMENTS

| | | | |
|---|---|---|---|
| 4,479,049 | 10/1984 | Hirose | 209/534 X |
| 4,625,870 | 12/1986 | Nao et al. | 271/3.1 X |
| 4,697,071 | 9/1987 | Hiraoka et al. | 235/379 |
| 4,726,474 | 2/1988 | Arikawa et al. | 271/3.1 X |
| 4,739,156 | 4/1988 | Watanabe | 235/379 |
| 4,744,468 | 5/1988 | Goi et al. | 194/206 X |

FOREIGN PATENT DOCUMENTS

| | | |
|---|---|---|
| De. 3517848 | 5/1985 | Fed. Rep. of Germany . |
| 58-39392 | 3/1983 | Japan . |
| 60-59492 | 4/1985 | Japan . |
| 60-67334 | 4/1985 | Japan . |
| 60-78332 | 5/1985 | Japan . |
| 60-100283 | 6/1985 | Japan . |
| 60-251487 | 12/1985 | Japan . |
| 61-18087 | 1/1986 | Japan . |

*Primary Examiner*—Joseph J. Rolla
*Assistant Examiner*—Edward S. Ammeen
*Attorney, Agent, or Firm*—Fleit, Jacobson, Cohn & Price

[57] ABSTRACT

A bill receiving and dispensing machine of "specific type of bill circulation-type" which can reuse, as bills for dispensation, only one specific type of bills among all types of received bills. According to the machine of the present invention, only one type of bills among all types of received bills is circulated through a circulating-bill pooling section for reuse as bills for dispensation and the dispensation bills other than the circulating bills are held in a dispensation bill container and the received bills and the dispensation bills are held in three limited sections, i.e. a circulating-bill pooling section, a received-bill container and a dispensation bill container. This makes it possible to eliminate the special bill pooling sections and the bill feeding-out mechanisms which are used in the conventional machines and therefore to simplify the mechanism and to reduce the noise during the operation thereof. Also according to the present machine, a common route, an accumulating route, a bill deliverer and a transaction port are so designed that they are always commonly used in both the bill receiving and bill-type separating mode and the bill dispensing mode. This makes it possible to effectively utilize the space within the machine body and thus to reduce the volume of the machine body.

1 Claim, 15 Drawing Sheets

BILL RECEIVING, DISCRIMINATING, AND DISPENSING MACHINE

BACKGROUND OF THE INVENTION

The present invention relates to a bill receiving and dispensing machine and more particularly to a "specific type of bill circulation-type" bill receiving and dispensing machine which can reuse, as bills for dispensation, only one specific type of bills among all types of received bills.

Heretofore, there has been known a so-called "circulation-type" bill receiving and dispensing machine which permits the received bills to be reused as the bills for dispensation, to improve the efficiency of bill receiving and dispensing operation.

Japanese laid-open patent publication No. 100283/1985 discloses such a circulation-type bill receiving and dispensing machine which is adapted to pool the received bills within received-bill distributing box after discrimination and then to hold the bills fed out one by one from the received-bill distributing box within each classification box such as a 10,000 yen box, a 5,000 yen box and a 1,000 yen box during bill receiving operation, and to dispense the bills to a transaction port through a bill dispensing route with the bills feeding out one by one from each classification box during bill dispensing operation in response to a dispensation command from the user.

However, the bill receiving and dispensing machine of the prior art requires that each classification box be connected to the bill dispensing route without any interference therebetween and that the received-bill distributing box be disposed at a place where the classification boxes are not situated. In addition, it is required to provide each classification box and the received-bill distributing box with an accumulation wheel and a feeding-out mechanism. This not only enlarges the machine body but also complicates the mechanisms, which increases noise during bill receiving and dispensing operations.

Moreover, frequent bill charging operation is required every time the box for a specific type of bills becomes empty or nearly empty because there is sometimes a large demand for a specific type of bill. This requires the supervisor of the machine to frequently load the machine with bills of the type concerned, which is troublesome.

SUMMARY OF THE INVENTION

It is an object of the present invention to provide a compact, low-noise bill receiving and dispensing machine which is able to circulate only one type of bill and to simplify handling of the remaining kinds of bills.

According to the present invention, there is provided a bill receiving and dispensing machine comprising: transaction port means for pooling received bills and bills for dispensation and which communicates with the outside of the machine body and has a mechanism for taking the received bills one by one into the inside of the machine body; discriminating route means for discriminating the received bills fed out one by one from said transaction port means; circulating-bill pooling means positioned below said discriminating route means and the center of the machine body and adapted to pool the bills of the same type as the circulating bills which are selected from said received bills and used as bills for dispensation; received-bill containing means positioned in parallel with and in front of said circulating-bill pooling means and adapted to pool bills of other types than said circulating bills; bill receiving route means for connecting said discrimination route means to said circulating-bill pooling means and said received-bill containing means; common route means adapted to be connected to said discriminating route means selectively with said bill receiving route means; bill delivering means connectable to said common route means and adapted to temporarily pool the received bills entering said transaction port means until completion of discrimination thereof and also to feed out again the pooled bills to said dealing port means; dispensation-bill containing means positioned below said circulating-bill pooling means and said received-bill containing means in inclined condition relative to the machine body and adapted to pool bills for dispensation of other types than said circulating bills; and, bill dispensing route means connected to said circulating-bill pooling means and said dispensation-bill containing means through a bill feeding-out mechanism which feeds out bills one by one and is also connected to said common route means.

The bill receiving and dispensing machine of the present invention is designed: to circulate, through the circulating-bill pooling means, only one type of bill among all types of received bills in order to reuse the one type of bills for dispensation; to hold other types of bills within the received-bill containing means; and to dispense bills other than the circulating bills from the dispensation bill containing means. During the received-bill handling operation, the received bills entering the transaction port means are temporarily pooled after discrimination thereof within the bill delivering means through the common route means and then transferred from the bill delivering means to the transaction port means again after completion of discrimination of all bills and finally pooled within either the circulating-bill pooling means or the received-bill containing means in accordance with the type of bill. On the other hand, during the bill dispensing operation, the bills pooled within the circulating-bill pooling means or the dispensation bill containing means are fed out therefrom in response to the amount of money for dispensation requested by the user and then transferred from the bill dispensing route means to the common route means to pool them within the bill delivering means and finally dispensed to the dealing port means from the bill delivering means. That is, according to the present invention, the common route means, the bill delivering means and the dealing port means are so constructed that they are commonly used in both the received-bill handling operation and the bill dispensing operation.

BRIEF DESCRIPTION OF THE DRAWINGS

Other objects and advantages of the present invention will become apparent from the following detailed description of a preferred embodiment of the present invention taken in reference to the accompanying drawings in which.

DESCRIPTION OF THE PREFERRED EMBODIMENT

Figure 1:
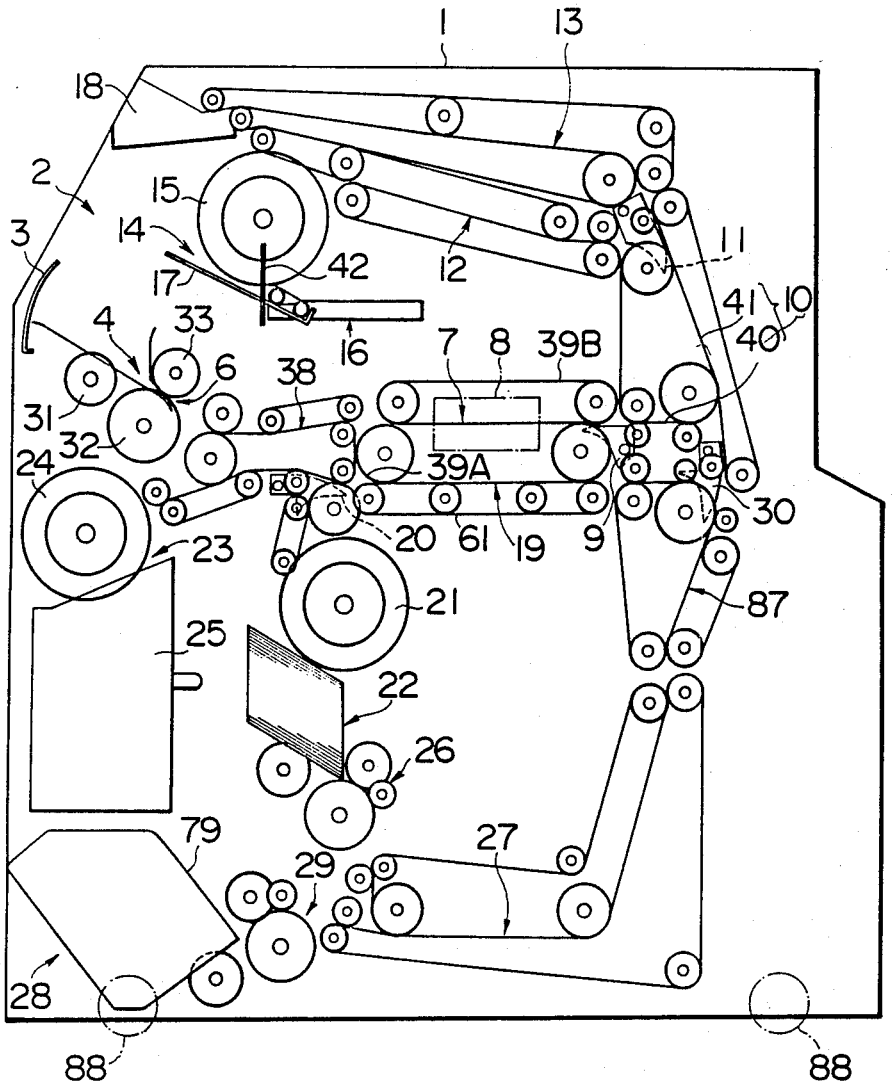
FIG. 1 is a side elevational view schematically showing the general construction of one embodiment of the bill receiving and dispensing machine of the present invention.

The bill receiving and dispensing machine shown in this embodiment is designed for circulating and reusing a specific type of bill, for example only 10,000 yen bills, among all types of received bills which may include 1,000 yen, 5,000 yen and 10,000 yen bills.

First, general arrangement of the bill receiving and dispensing machine of the present invention will be explained referring to FIG. 1.

When a user issues a command requesting bill acceptance, a shutter 3 of a transaction port 2 mounted on a machine body 1 is opened to expose a bill receiving and dispensing mouth 4. In the case that bills (or a bill) are actually inserted into the dealing port 2, the received bills are pressed by a bill pressing mechanism 5 (FIG. 2) with proper pressure and fed out one by one by a received-bill feeding-out mechanism 6 and then transferred to a discriminating section 8 through a discriminating route 7. The discriminated bills are guided into a common route 10 by a first fork 9. Bills discriminated as genuine at the discriminating section 8 are guided by a second fork 11 into an accumulating route 12. On the contrary, bills discriminated as counterfeit are guided into a rejection route 13. The genuine bills passing through the accumulating route 12 are continuously accumulated on a supporting plate 17 forming one part of an accumulating and transferring mechanism 16 via an accumulation wheel 15 for temporary pooling which forms a part of a bill delivering means 14, and the counterfeit bills passed through the rejection route 13 are fed into a rejection port 18.

The bills accumulated on the supporting plate 17 are transferred to a position above the mouth 4 and dropped thereon, and further transferred to the discriminating route 7 again by the received-bill feeding-out mechanism 6. Bills discriminated as 10,000 yen bills at discriminating section 8 are guided into a bill receiving route 19 by the first fork 9 and then fed into a circulating-bill pooling section 22 by a third fork 20 through an accumulating wheel 21 for circulating bills. On the contrary, bills other than 10,000 yen bills are guided into a received-bill containing means 23 by the third fork 20 and then accommodated in a received-bill box 25 via an accumulation wheel 24 for holding received bills.

When a bill dispensation command is made by the user, the 10,000 yen bills are fed out to a bill dispensing route 27 from the circulating-bill pooling means 22 by a circulating-bill feeding-out means 26. Bills other than 10,000 yen bills, for example, 1,000 yen bills or 5,000 yen bills, are supplied beforehand to a dispensation bill containing means 28 and fed out by a dispensation bill feeding-out mechanism 29 to the bill dispensing route 27. During these operations, a check is made for abnormalities, for example, to determine whether the bills for dispensation are being fed in an overlapped condition. When an abnormality is found, the bills are returned to the received bill box 25 of the received-bill containing means 23 by a fourth fork 30, the bill receiving route 19 and the third fork 20. On the contrary, when no abnormality is found, the bills are guided to the common route 10 by the fourth fork 30 and then guided by the second fork 11 to the accumulating route 12. The bills on the accumulating route 12 are then continuously accumulated on the supporting plate 17 by the accumulation wheel 15 for temporary pooling. After having accumulated thereon to a desired amount of money, the bills on the supporting plate 17 are dropped into the bill receiving and dispensing mouth 4 by driving the accumulating and transferring mechanism 6. Finally, by opening the shutter 3, it permits the user to take out the bills from the mouth 4.

Figure 2:
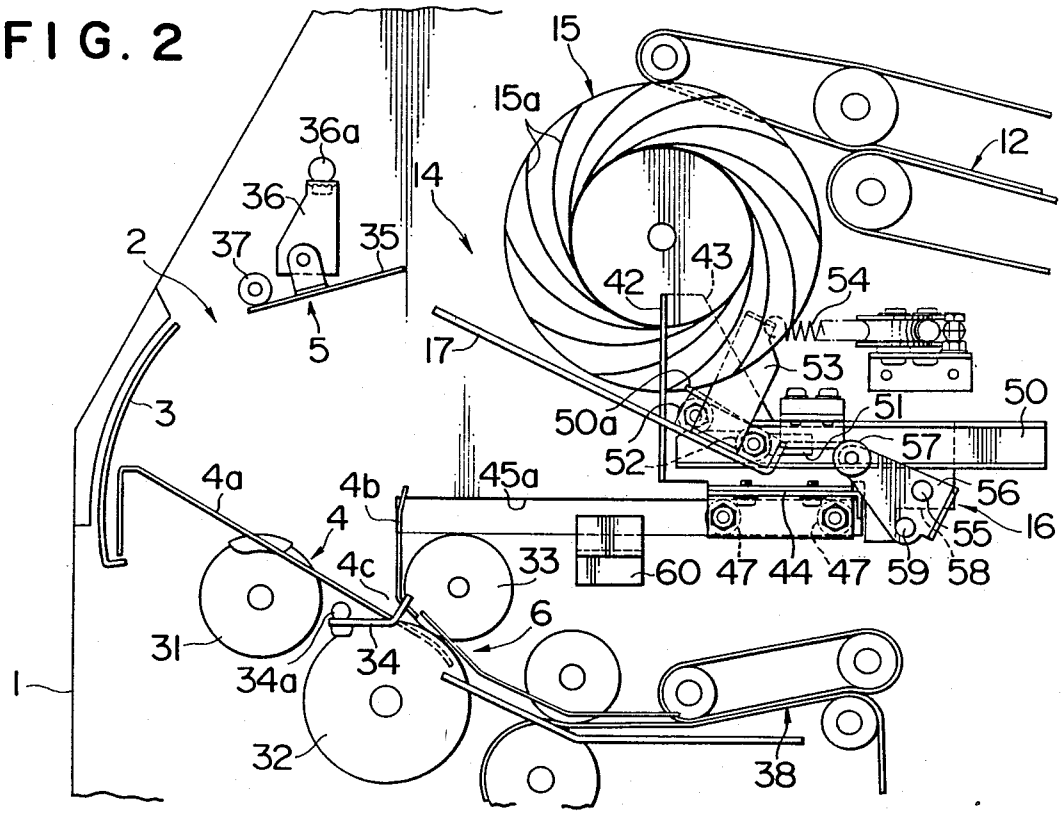
FIG. 2 is an enlarged vertical cross-sectional view showing the transaction port means and the bill delivering means of the machine of FIG. 1.

More details on each part of the machine will hereinafter be explained. As shown in FIG. 2, the bill receiving and dispensing mouth 4 of the transaction port means 2 comprises a supporting plate 4*a* descending from the shutter 3 and a vertical plate 4*b* by which the ends of the accumulated bills on the supporting plate 4*a* are flushed. An opening 4*c* for feeding out the bills is formed between these plates 4*a* and 4*b*.

Also, as shown in FIG. 2, the received-bill feeding-out mechanism 6 comprises a roller 31 for ejecting the lowermost bill of the accumulated bills one by one from the opening 4*c*, a roller 32 for taking the ejected bills into an introducing section 38 by the frictional force of the roller 32 contacting with the bills a roller 33 arranged opposite to the taking-in roller 32 which is either non-rotational relative to the taking-out roller 32 or rotational counter to the feeding-out direction of the bills in order to prevent overlapped feeding of bills, and a member 34 which normally closes the opening 4*c* to flush the ends of lowermost bills and opens the opening 4*c* by pivoting around its supporting shaft 34*a* for permitting the bills to pass therethrough.

The bill pressing mechanism 5 acts for assisting the bill taking-in operation at the transaction port means 2 and comprises a pressing plate 35 pivotably suspended from a supporting member 36 which in turn is mounted on a shaft 36*a* for being verticaly movable to lower the pressing plate 35 so as to press the upper surface of the bills when the bills are taken into the machine. However, except when the machine is in bill taking-in operation, the pressing plate 35 is kept in a standby position upwardly away from the mouth 4 and also kept in an inclined position by a positioning member 37 in order to prevent interference with the bill transfer motion of the bill delivering means 14, which will be hereinafter explained.

Referring again to FIG. 1, the discriminating route means 7 is arranged behind the received-bill feeding-out mechanism 6 through an introducing section 38 which receives the bills fed out one by one and transfers them to transfer belts 39A and 39B. These transfer belts 39A and 39B horizontally sandwich the bills therebetween and transfer them to the discriminating section 8 at which the genuineness, type, and number of the bills are discriminated.

The common route means 10 comprises a horizontal transfer section 40 lying on an extension of the discriminating section 7 and an elevational transfer section 41 which guides the bills upward. The accumulating route 12 and the rejecting route 13 are arranged behind the elevational transfer section 41 through the second fork 11.

As shown in FIG. 2, the bill delivering means 14 connected to the accumulating route 12 is positioned diagonally upward from the transaction port means 2 and comprises the accumulation wheel 15 for temporary pooling which has vanes 15*a* for receiving the bills fed out from the accumulating route 12 one by one therebetween and the accumulating and transferring mechanism 16 which drops the bills into the mouth 4 after having received and accumulated the bills on the supporting plate 17.

The accumulating and transferring mechanism 16 includes scraping members 42 arranged vertically at both sides of the accumulation wheel 15 to scrape the bills from the vanes 15*a*, and the supporting plate 17 for accumulating the bills scraped and dropped from the vanes 15*a*. These scraping members 42 and the supporting plate 17 are moved horizontally by a driving mechanism which is constructed in the following manner.

Figure 3:
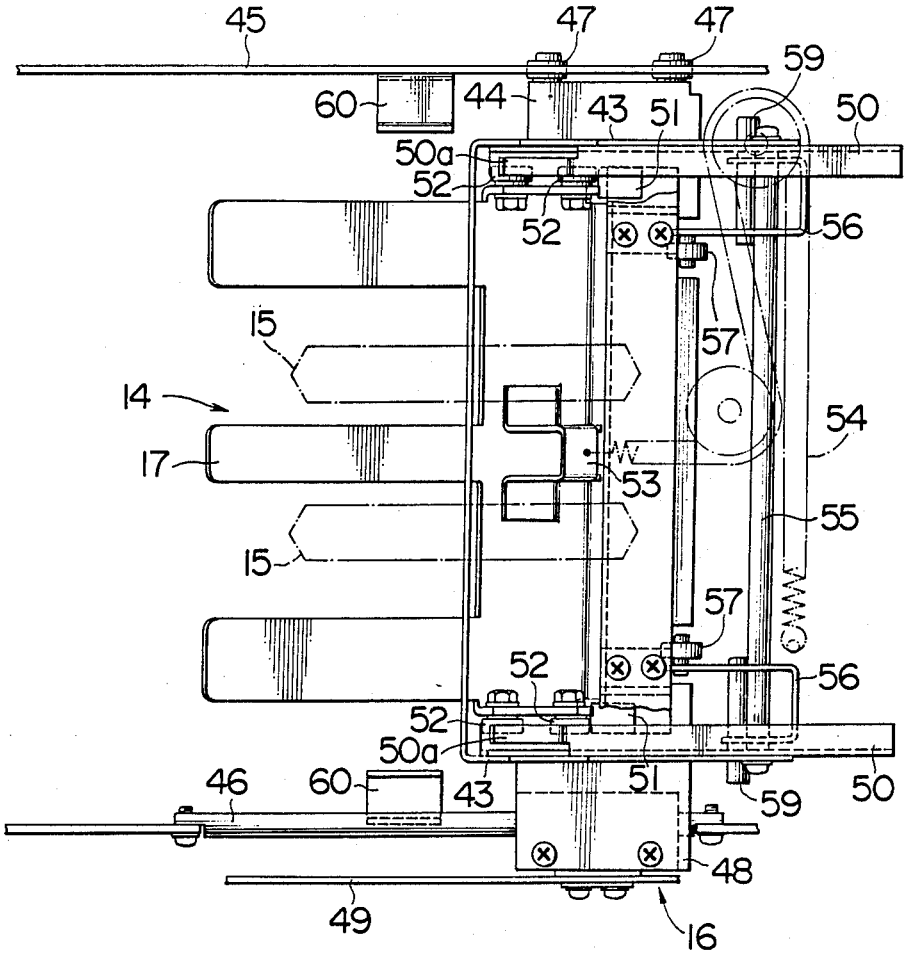
FIG. 3 is a plan view of the bill delivering means of the machine of FIG. 1.
Figure 4A:
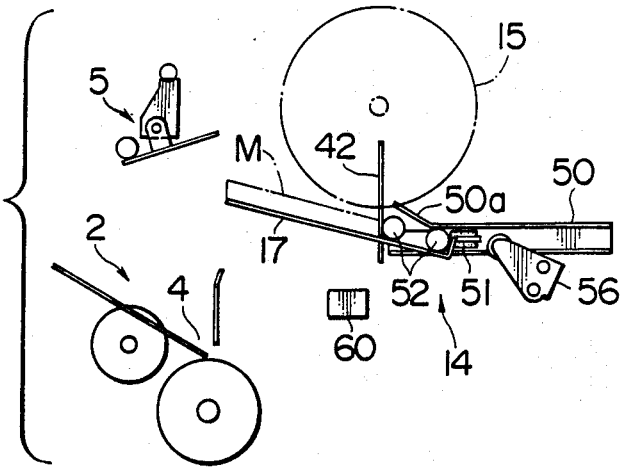
FIGS. 4(*a*)–(*e*) are explanatory drawings showing the steps of operation of the bill delivering means of the machine of FIG. 1.
Figure 4B:
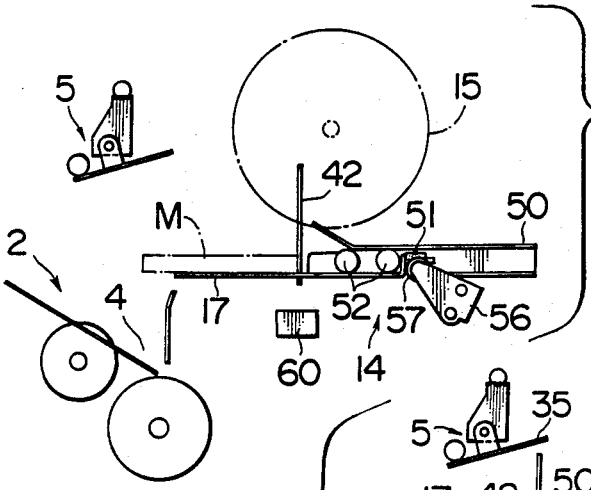
Figure 4C:
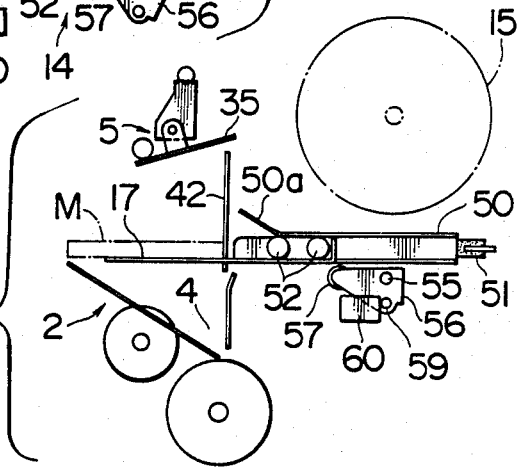
Figure 4D:
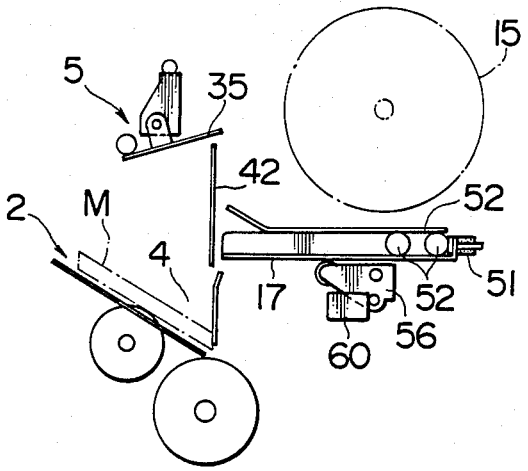
Figure 4E:
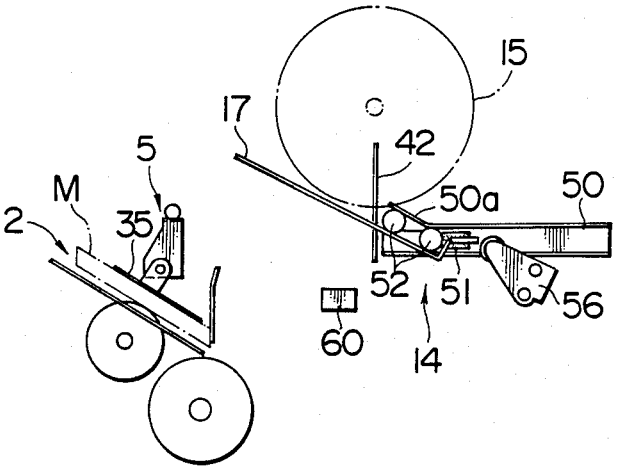

That is, as shown in FIGS. 2 and 3, side plates 43 are mounted on the scraping members 42 at both sides thereof. A horizontal mounting plate 44 supporting the bottom of the side plates 43 extends between a horizontally elongated slot 45*a* formed in a supporting frame 45 for supporting the mounting plate 44 and a horizontal shaft 46 and is slidably supported on the rollers 47. The mounting plate 44 has a driving block 48 secured thereto which in turn is connected to a reversible driving motor (not shown) through a driving belt 49. Thus the mounting plate 44 can be moved horizontally along the elongated slot 45*a* by the driving motor. In addition, the mounting plate 44 has a pair of slide rails 50 secured thereon. Each slide rail 50 has a "C" shaped cross-section and the rails are so arranged that its open-groove face toward each other. The fore end of each slide rail 50 has an upwardly inclined portion 50*a*. A stopper 51 fixed on the machine body 1 projects into the inside of each slide rail 50. As best shown in FIG. 3, the fore end of the supporting plate 17 is divided into a plurality of fingers adapted to pass through notches (not shown) formed in the scraping members 42 and the base end of the supporting plate 17 is provided with guide rollers 52 contacting with the slide rails 50. One end of a spring 54 is secured to the machine body 1 and the other end is attached to a supporting piece 53 which is secured to the base end of the supporting plate 17. Owing to the pulling force of the spring 54 acting on the supporting piece 53, the supporting plate 17 is kept in upwardly inclined condition as shown in FIG. 2 with the guide rollers 52 in contact with the upwardly inclined portion 50*a* of the slide rails 50 and the stoppers 51. Each side plate 43 is provided with a pushing-out piece 56 pivotable around a shaft 55. Each pushing-out piece 56 is in turn provided with a pushing-out roller 57 swingable in a space between the slide rails 50, together with the pivotal motion of the pushing-out piece 56, and an engaging shaft 59 engageable with a notch 58 formed in each side plate 43. The pushing-out piece 56 is usually urged clockwise in FIG. 2 by a spring (not shown). FIG. 2 shows the engaging shafts 59 in engagement with the notches 58 and the pushing-out rollers 57 projected into the space between the slide rails 50 behind (right-hand in FIG. 2) the stoppers 51. Furthermore, an engaging member 60 is fixed on the machine body 1 at a position horizontally away toward the left from the engaging shaft 59 which is now in engagement with the notch 58 as shown in FIG. 2. The engaging member 60 abuts against the engaging shaft 59 and turns the pushing-out piece 56 counter-clockwise around its shaft 55 so as to retract the pushing-out roller 57 from the space between the slide rails 50 when the pushing-out piece 56 is moved leftward in FIG. 2 together with the scraping members 42 as hereinafter explained.

Referring again to FIG. 1, the received-bill handling route 19 is formed by the lower belt 39A of the upper and lower transferring belts 39B and 39A forming the discriminating route 7 and another transferring belt 61 arranged opposite to the lower transferring belt 39A. The bills are sandwiched between the lower transferring belt 39A and the opposed transferring belt 61 and transferred in a direction counter to that of the discriminating route 7.

The circulating-bill pooling section 22 which pools the bills distributed by the third fork 20 positioned behind the bill receiving route 19 while separating them into respective bill types is arranged at the center of the machine body 1. The received-bill containing means 23 is arranged at the front of the machine body 1. That is, they are arranged parallel to each other.

Figure 5:
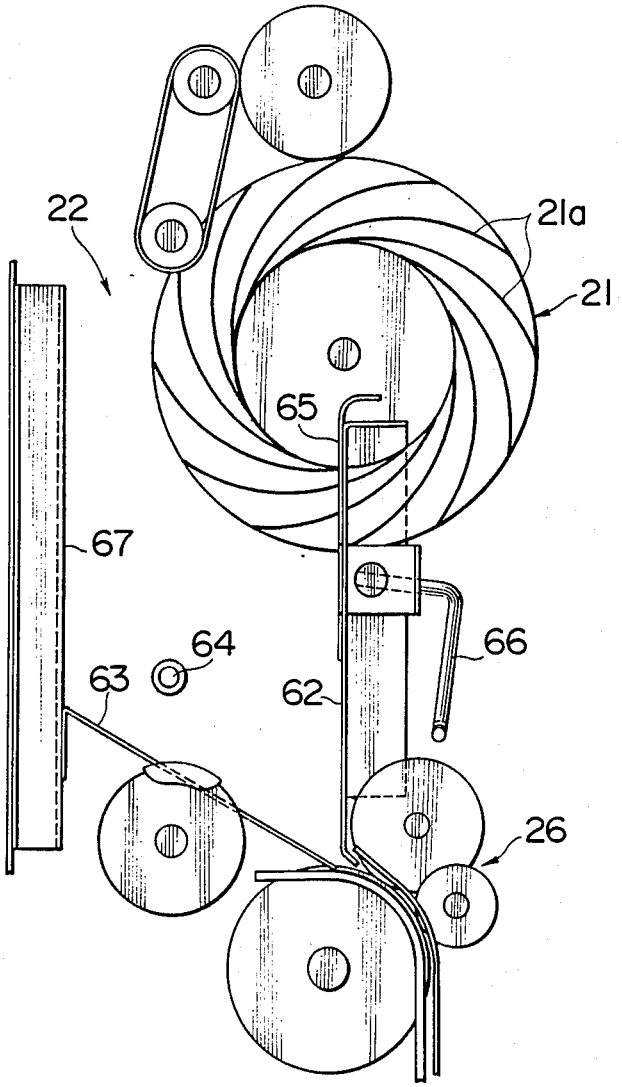
FIG. 5 is an enlarged vertical cross-sectional view of the circulating-bill pooling section of the machine of FIG. 1.

As shown in FIG. 5, the circulating-bill pooling section 22 comprises the accumulation wheel 21 adapted to receive the circulated bills one by one between its vanes 21*a*, scraping members 62 arranged at opposite sides of the wheel 21, a supporting plate 63 for stacking the bills thereon with the ends of the bills abutted against the scraping member 62, a sensor 64 for detecting the amount of bills on the supporting plate 63, and a pressing plate 65 for pressing the upper surface of the bills when the sensor 64 detects that the amount of bills has become less than a predetermined level. The pressing plate 65 has an arm 66 secured to the back thereof. The arm 66 is rotated by its driving means (not shown) and, as shown in FIG. 5, retracted from the upper area of the supporting plate 63 during accumulation of bills thereon. A vertical plate 67 closing the front side of the machine body 1 is formed with a closable opening (not shown) through which bills are dropped onto the supporting plate 63.

Figure 6:
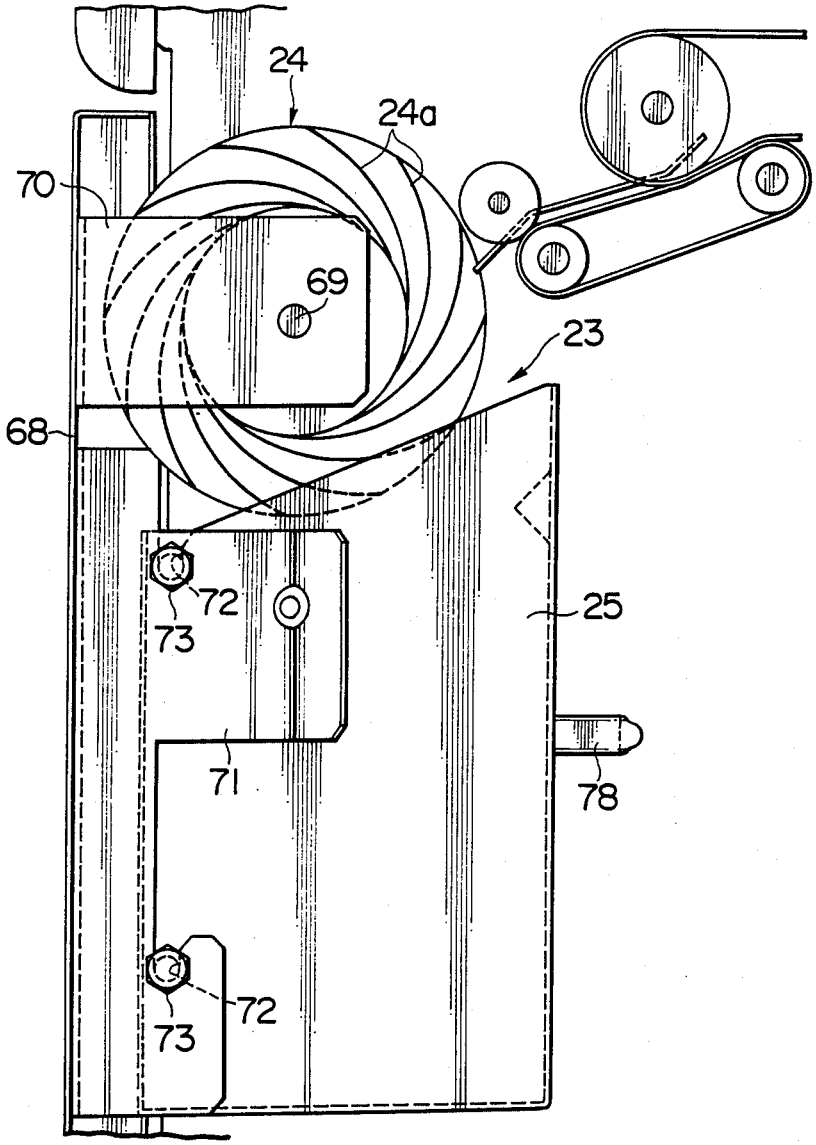
FIG. 6 is a side elevational view of the received-bill containing means of the machine of FIG. 1.

As shown in FIG. 6, the received-bill containing means 23 comprises the accumulation wheel 24, which has vanes 24*a* adapted to receive bills one by one therebetween, and the received-bill box 25. Both the wheel 24 and the box 25 are mounted on a door 68 which is adapted to open the front of the machine body 1. That is, a shaft 69 of the wheel 24 is rotatably supported by a bracket 70 secured on the door 68 and pins 73 of the box 25 are supported by notches 72 formed in the bracket 71 secured on the door 68. Accordingly, by opening the door 68, both the wheel 24 and the box 25 can be drawn out from the machine body 1. Furthermore, the circulating-bill pooling section 22 is also exposed at the front of the machine body 1 when the door 68 is opened.

Figure 7:
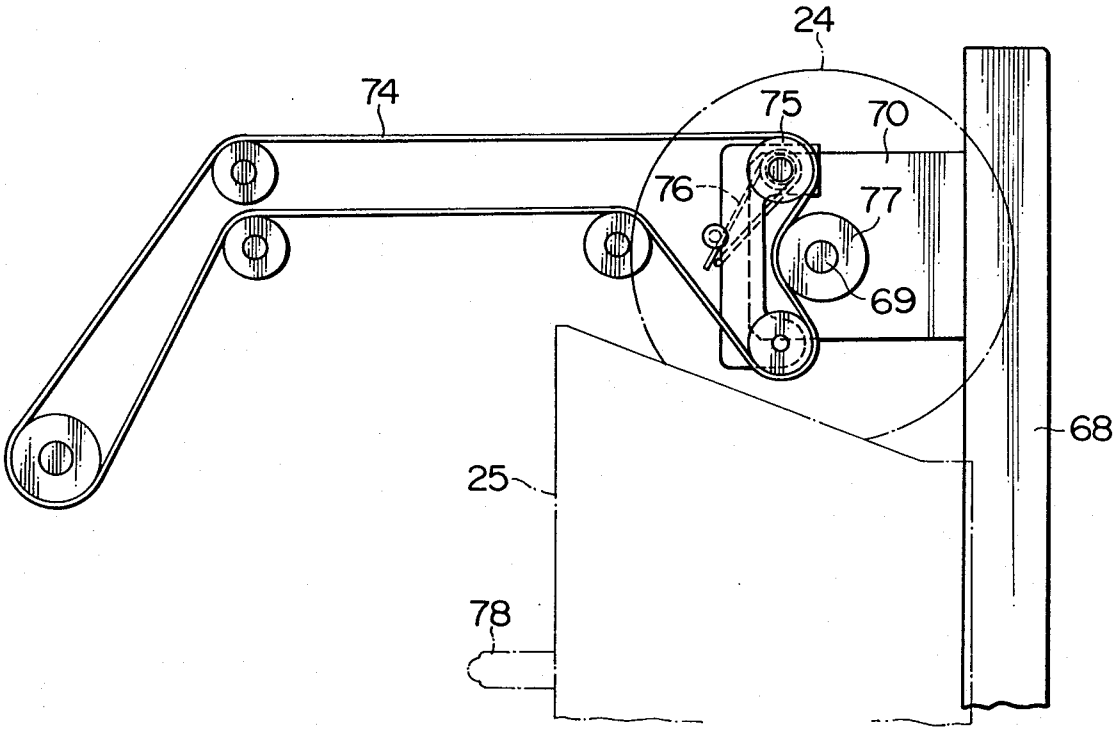
FIG. 7 is a side elevational view showing the connection between the accumulation wheel for received bills and its driving means in the received-bill containing means of the machine of FIG. 1.

As shown in FIG. 7, the accumulation wheel 24 is driven by a driving means (not shown) mounted on the machine body 1 through a timing belt 74 which is tensioned by a tension pulley 75 and an urging spring 76. A driving roller 77 secured to the driving shaft 69 of the wheel 24 is adapted to engage with the timing belt 74 when the wheel 24 is mounted on the machine body 1. As previously mentioned, the received-bill box 25 is detachably mounted on the door 68 and also provided with grips 78 for carrying the box 25 separately from the door 68.

Figure 8:
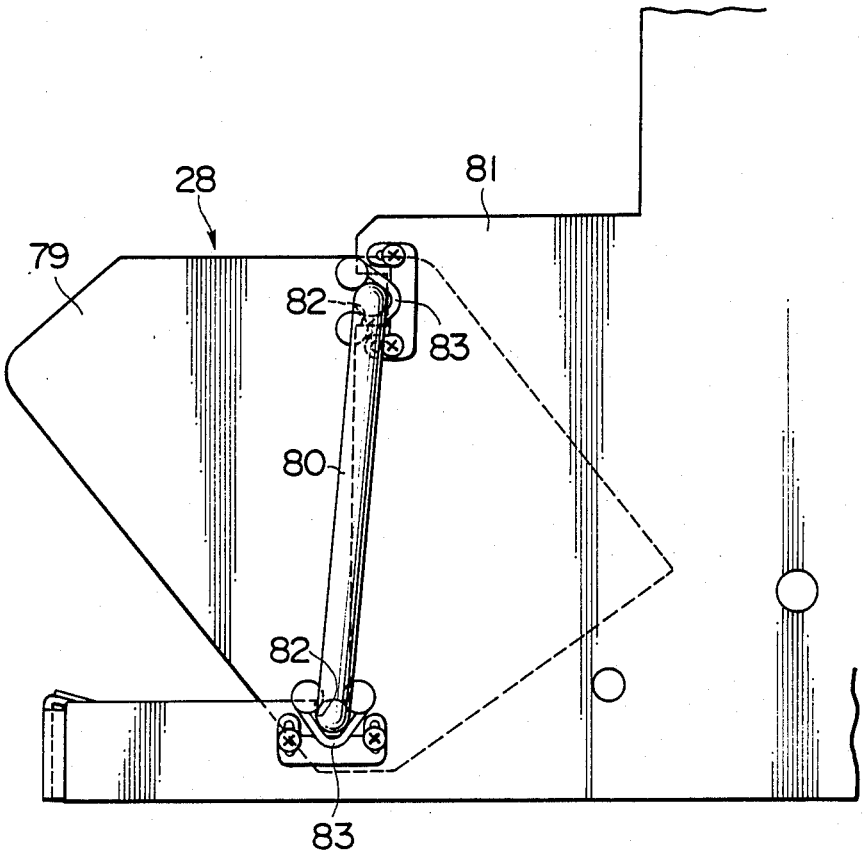
FIG. 8 is a side elevational view showing the dispensation bill containing means in which the dispensation bill box is attached to the machine body.

The dispensation bill containing means 28 is arranged below the box 25 (FIG. 1) and has a dispensation bill box 79 for holding the bills for dispensation. As shown in FIG. 8, the box 79 has a "U" shaped engaging lever 80 secured thereto and is adapted to be kept in inclined condition when the engaging lever 80 engages with notches 82 forced in a supporting frame 81 vertically and spaced apart from each other. Joining members 83 are arranged near the notches 82 to hold the box 79 in inclined condition with the joining members 83 snapped to the lever 80.

Figure 9:
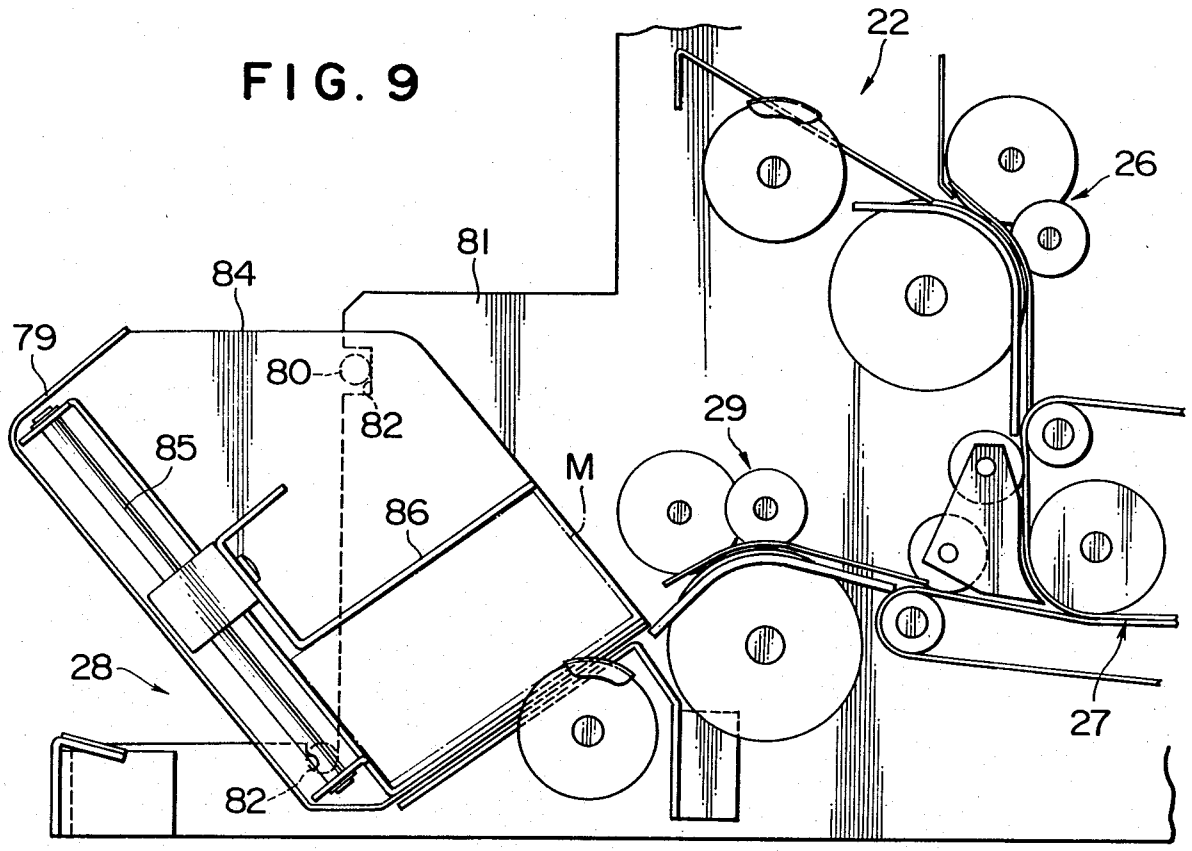
FIG. 9 is an enlarged cross-sectional view showing a portion near the received-bill containing means of the machine of FIG. 1.

As shown in FIG. 9, the box 79 has an opening 84 extending over an area from the top to the rear of the box 79 and can be exposed to the outside of the machine body 1 when the box 79 is rotated counter-clockwise around the bottom of the lever 80. A guide shaft 85 is arranged within the box 79 for guiding a pressure plate 86. The pressure plate 86 can be freely lowered by its own weight along the guide shaft 85 to always press the top surface of the bills M for dispensation in accordance with the amount of the bills M contained within the box 79.

As shown in FIG. 1, there are arranged, in the front end of the bill dispensing route 27, the circulating-bill pooling section 22, the circulating-bill feeding-out means 26 and the dispensation bill feeding-out mechanism 29. Also there are arranged sensors (not shown) between the bill dispensing route 27 and these means 22, 26 and 29 to detect the overlapped feeding of bills and to count the number of bills for dispensation. At the rear end of the bill dispensing route 27, there is arranged a distributing transfer section 87.

The distributing transfer section 87 is connected to the front end of the elevational transfer section 41 of the common route 10 and the front end of the bill receiving route 19, and the bills for dispensation are fed out from the distributing transfer section 41 to either the common route 10 or the bill receiving route 19 by the fourth fork 30 arranged at a connection therebetween.

The numeral 88 in FIG. 1 denotes casters for moving the machine 1.

The operation of the bill receiving and dispensing machine of the present invention will now be explained. First, the operation of the bill delivering means 14 will be explained referring to FIGS. 4(*a*)-(*e*).

As shown in FIG. 4(*a*), the supporting plate 17 of the bill delivering means 14 rotates counter-clockwise around the guide rollers 52 abutting against the stopper 51 when the bills M received from the accumulation wheel 15 for temporary pooling are stacked on the supporting plate 17 in accordance with the amount of bills. When the accumulating operation is completed, a motor (not shown) is actuated in response to a completion signal and the slide rails 50 are moved leftward along the elongated slots 45*a* (FIG. 2) and the horizontal shaft 46 (FIG. 3). Owing to the movement of the slide rails 50, the supporting plate 17 is positioned horizontally as shown in FIG. 4(*b*) with the supporting plate 17 moved relative to the slide rails 50 and abutted against the pushing-out rollers 57 of the pushing-out piece 56 by the urging force of the spring 54 (FIGS. 2 and 3).

Then as shown in FIG. 4(*c*), when the slide rails 50 are moved leftward with the pushing-out rollers 57 pushing the supporting plate 17 until the supporting plate 17 is positioned above the bill receiving and dispensing mouth 4 of the dealing port means 2, the engaging shaft 59 of the pushing-out piece 56 abuts against the engaging member 60 and therefore the pushing-out piece 56 is rotated counter-clockwise around the supporting shaft 55. Owing to the rotation of the pushing-out piece 56, the supporting force for the supporting plate 17 by the pushing-out rollers 57 is lost and therefore the supporting plate 17 is horizontally retracted along the slide rails 50 by the urging force of the spring 54 until the guide rollers 52 abut against the stoppers 51 as shown in FIG. 4(*d*). Thus the bills M stacked on the supporting plate 17 drop into the mouth 4. Then, by driving the slide rails 50 rightward and by returning them to the original position with the driving motor reversed, the supporting plate 17 is returned to its original inclined position as shown in FIG. 4(*e*). The condition of FIG. 4(*e*) is that when the machine is in the received-bill handling operation and therefore the upper surface of the stack of bills M is in pressed condition by the pressing plate 35 of the bill pressing mechanism 5 which is operated after the bills M are fed to the transaction port means 2.

Figures 10, 10A:
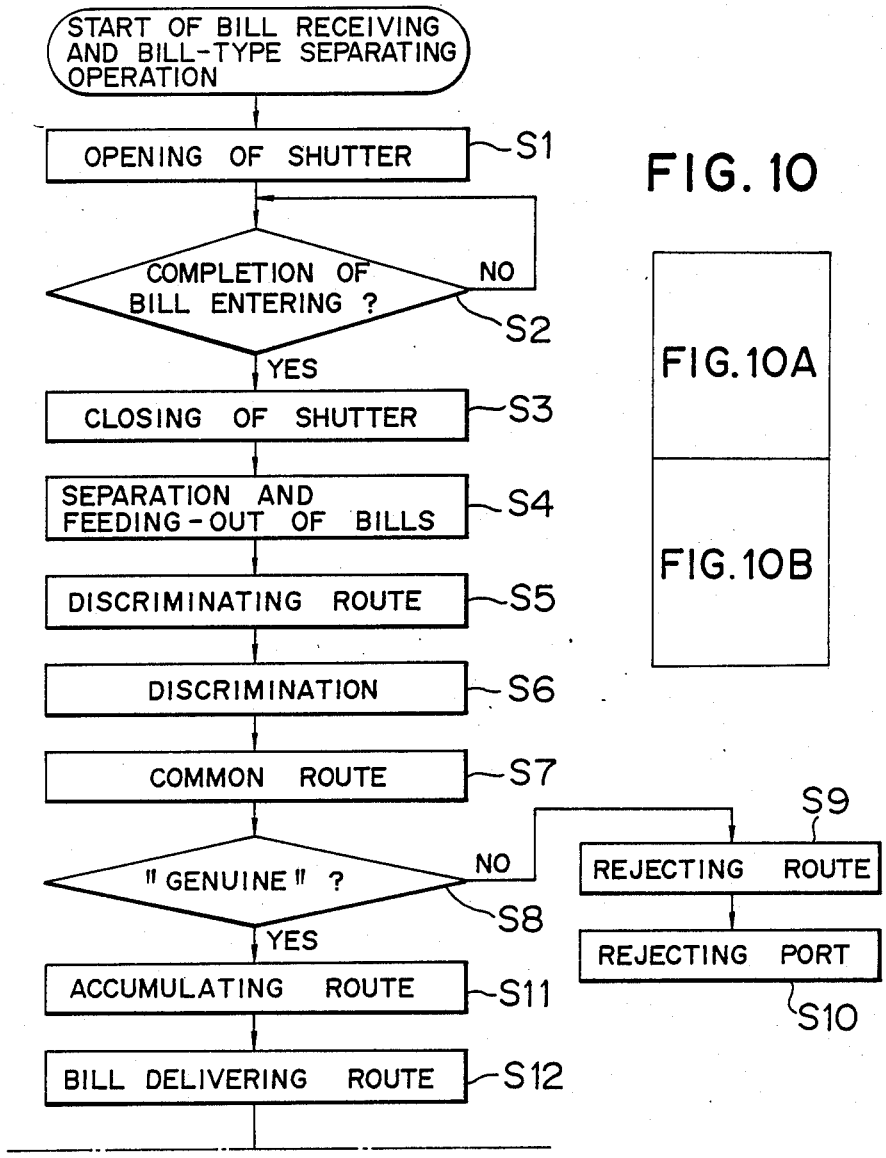
FIGS. 10, 10A and 10B show a flow chart of the bill receiving and bill-type separating mode operation in the machine of FIG. 1.
Figure 10B:
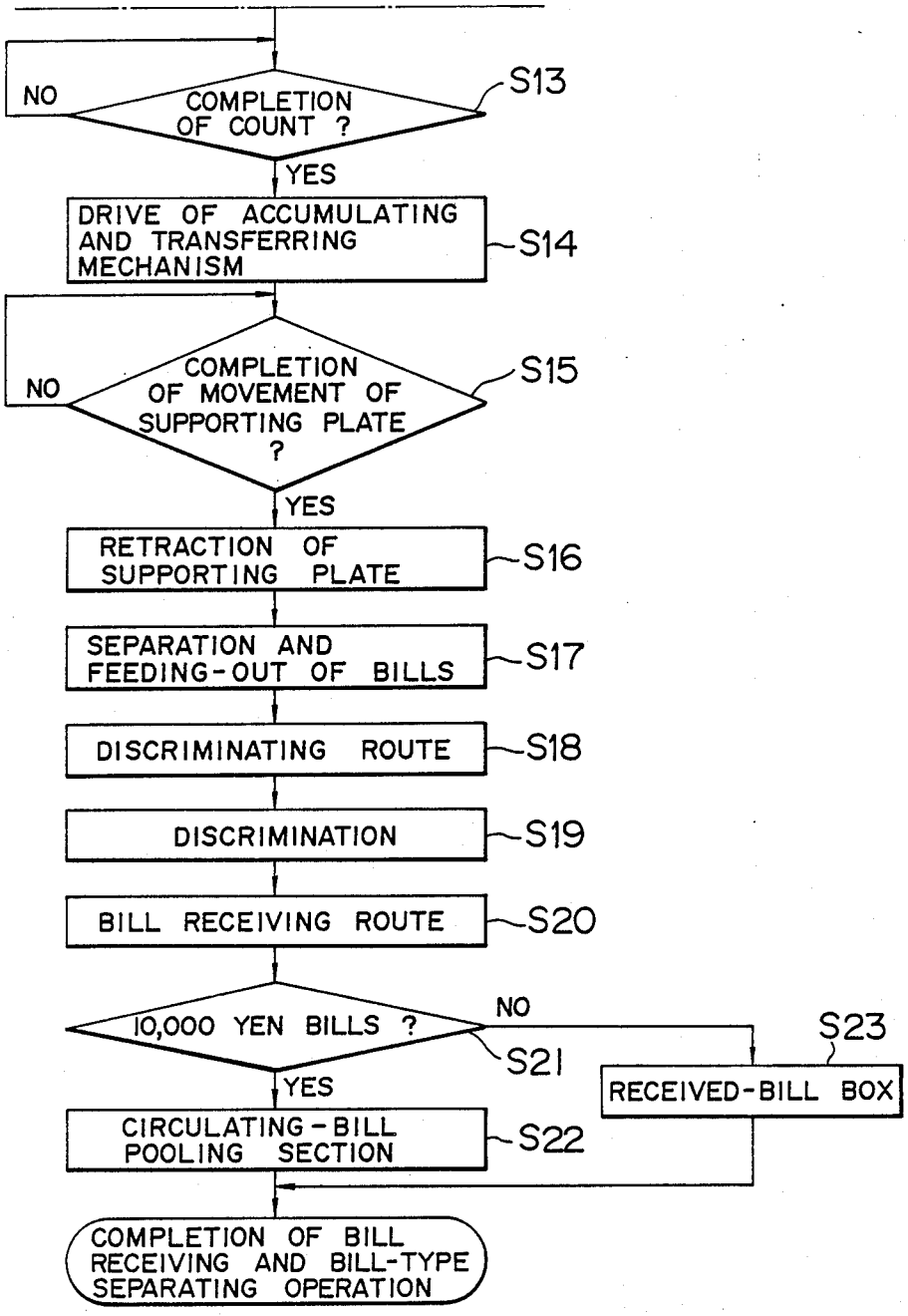
Figure 11A:
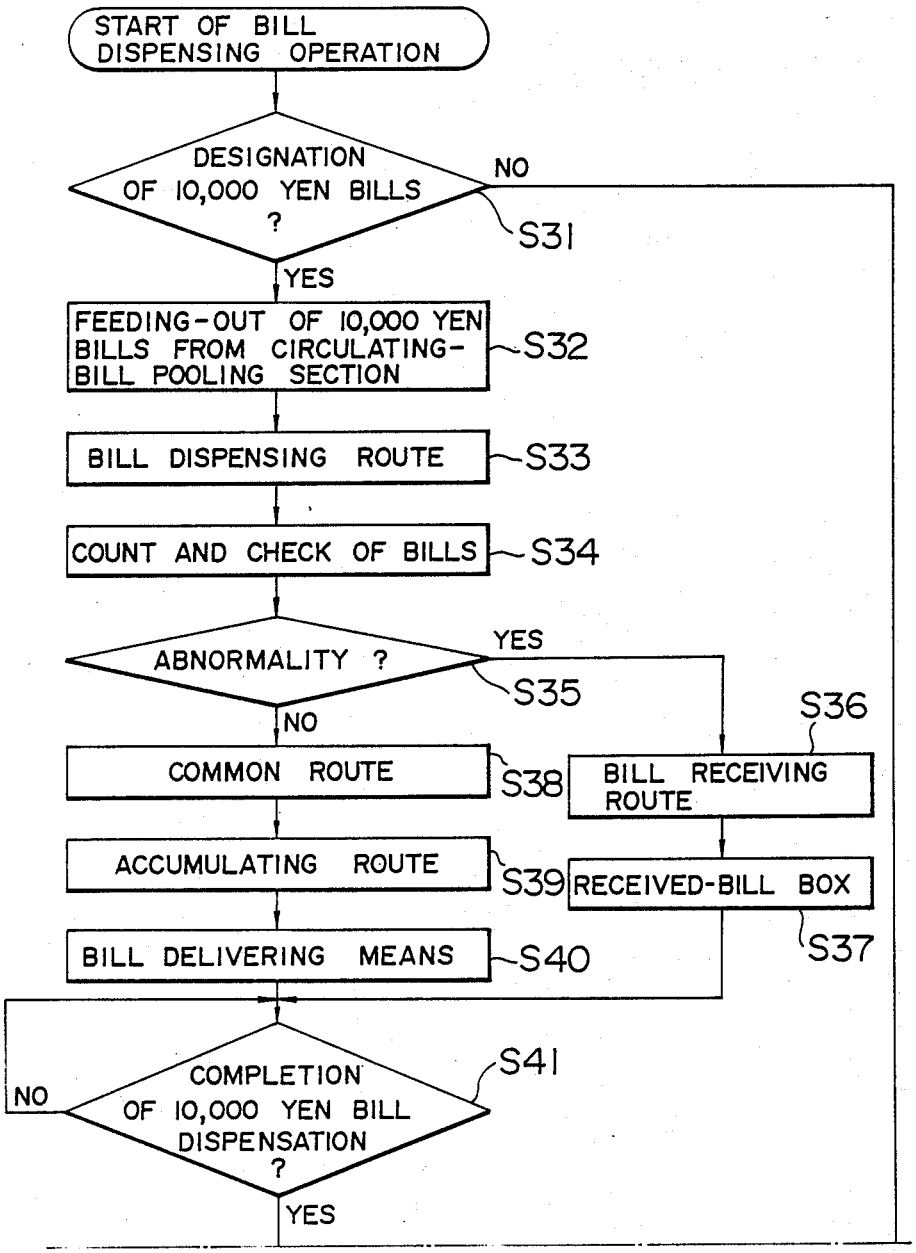
FIGS. 11, 11A 11B and 11C show is a flow chart of the bill dispensing mode operation in the machine of FIG. 1.
Figure 11B:
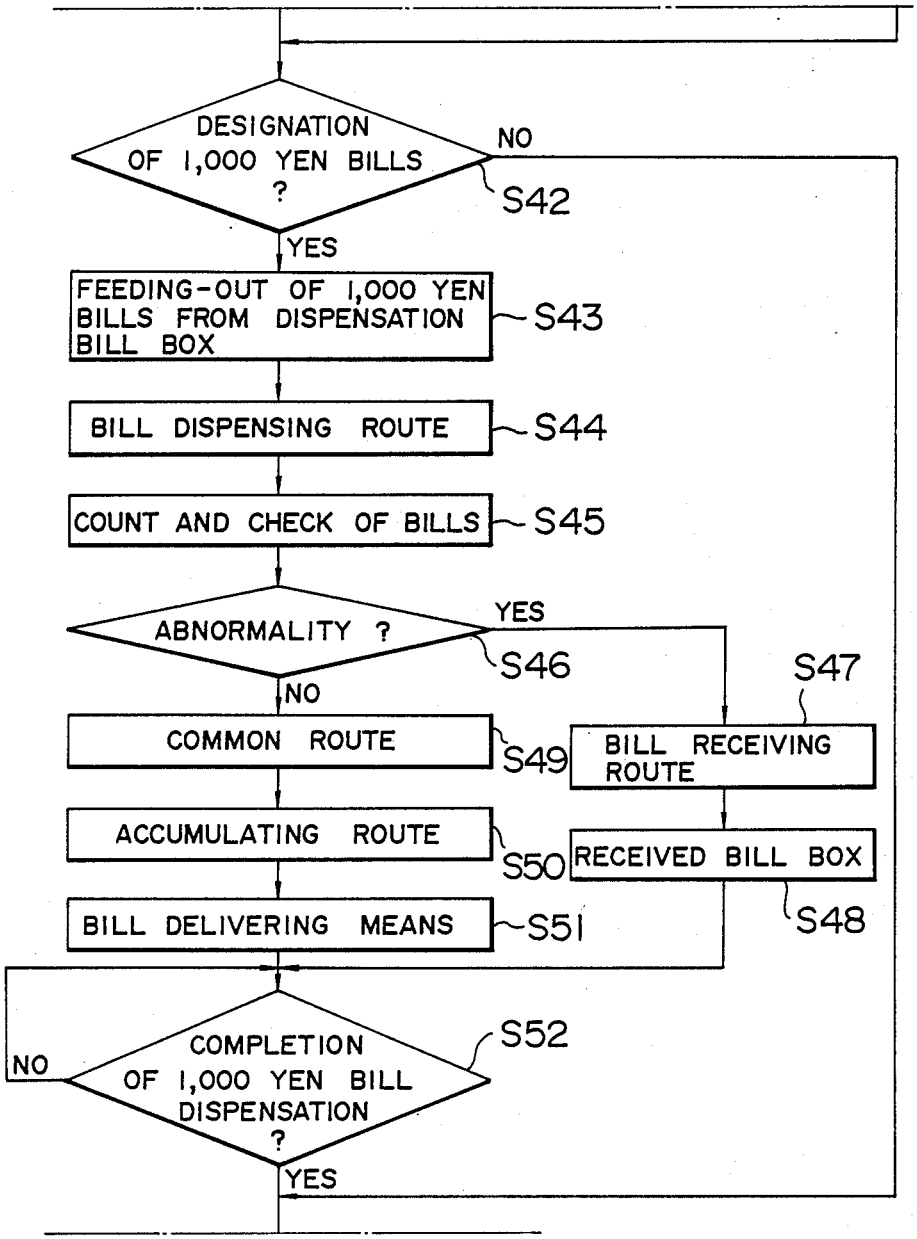
Figure 11C:
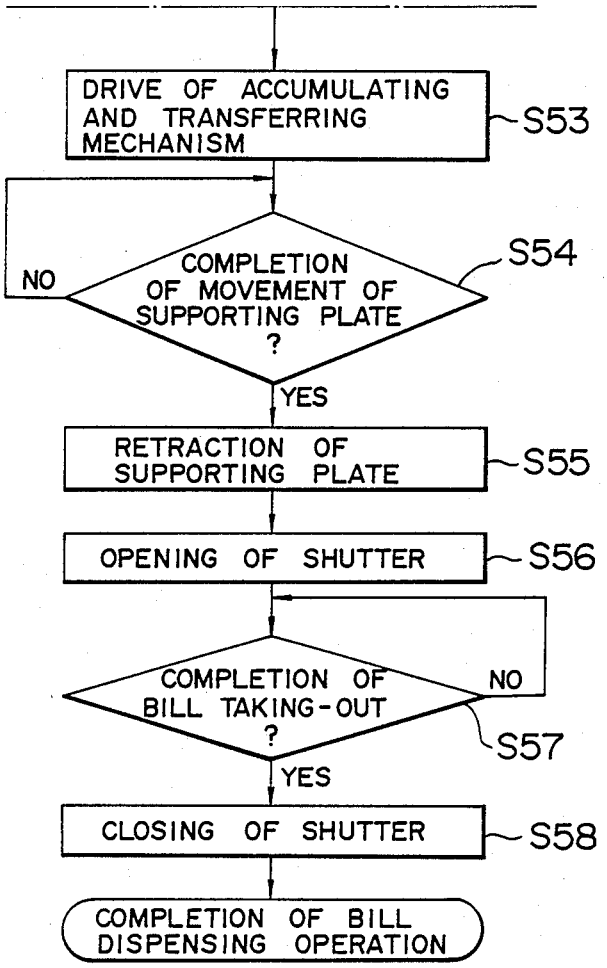
Figure 11:
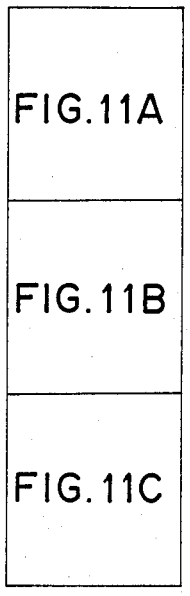

Next, the bill receiving and bill-type separating operation and the bill dispensing operation will be explained with reference to FIG. 10 and FIG. 11, respectively. The following explanations are made on the assumption that two types of bills, such as 10,000 yen bills and 1,000 yen bills, are used as the bills for dispensation.

Bill Receiving and Bill-type Separating Operation

S 1: The shutter 3 is opened when a bill acceptance command is made by the user.

S 2: In response to the next command indicating that the bill insertion operation has been completed, it is discriminated whether the bills have really been inserted. When insertion of the bills has been confirmed, the procedure moves to step S 3.

S 3: The shutter 3 is closed.

S 4: The bills are separated one by one and fed to the bill introducing section 38 by the received-bill feeding-out mechanism 6.

S 5: The bills received from the bill introducing section 38 are passed through the discriminating section 8 by the discriminating route means 7.

S 6: Genuineness and type of bills are discriminated while they pass through the discriminating section 8 and then the number of bills discriminated as genuine are counted.

S 7: The first fork 9 is positioned to connect the discriminating route means 7 to the common route means 10 as shown in FIG. 1 and the bills are transferred to the common route 10.

S 8: The sensors of the common route means 10 discriminate whether the result of discrimination as "genuine" at the discriminating section 8 (S 6) is true. When the discrimination of "genuine" is true, the procedure moves to step S 9 and, on the contrary, when it is not true, it moves to step S 11.

S 9: When the bills are counterfeit (not genuine), they are transferred by the rejection route 13 with the common route 10 connected to the rejection route 13 by the second fork 11.

S 10: The counterfeit bills are fed to the rejection port 18 through the rejection route 13.

S 11: When the bills are genuine, the bills are transferred through the accumulating route 12 with the common route 10 connected to the accumulating route 12 by the second fork 11.

S 12: The genuine bills are fed to the bill delivering means 14 through the accumulating route 12.

S 13: Whether the counting operation of the received bills is completed is discriminated. When it is found that the counting operation is completed, the procedure moves to step S 14.

S 14: Drive the accumulating and transferring mechanism 16 of the bill delivering means 14 and move the supporting plate 17 and the scraping members 42 together with the slide rails 50.

S 15: Continue to drive the accumulating and transferring mechanism 16 until the movement of the supporting plate 17 and the scraping members 42 is completed (that is, until the supporting plate 17 arrives at a position above the bill receiving and dispensing mouth 4). When it is discriminated that the movement has been completed, the procedure advances to step S 16.

S 16: The bills stacked on the supporting plate 17 are dropped into the mouth 4 with the supporting plate 17 retracted by the spring 54 simultaneously with the completion of movement of the supporting plate 17 in step S 15. The mounting plate 44 is returned to its original position by reverse rotation of the driving motor for the accumulating and transferring mechanism 16.

S 17: Feed out one by one the bills dropped into the mouth 4 by the received-bill feeding-out mechanism 6.

S 18: Transfer the bills through the discriminating route 7.

S 19: Discriminate the type of bills.

S 20: Transfer the bills through the bill receiving route 19 with the discriminating route 7 connected to the bill receiving route 19 by the first fork 9.

S 21: Discriminate whether the bills transferred by the received-bill handling route 19 are 10,000 yen bills. When it is discriminated that the bills are 10,000 yen bills, the procedure moves to step S 22. Otherwise, it goes to step S 23.

S 22: Pool the 10,000 yen bills in the circulating-bill pooling section 22.

S 23: Pool the bills other than 10,000 yen bills in the received-bill box 25 of the received-bill containing means 23.

Thus, the whole cycle of the bill receiving and bill-type separating operation is completed.

Bill Dispensing Operation

S 31: When a bill dispensing command is issued by the user, it is discriminated whether any 10,000 yen bills were requested. When it is discriminated that 10,000 yen bills were requested the procedure moves to step S 32. Otherwise, it moves to step S 42.

S 32: Feed out the 10,000 yen bills one by one in accordance with the user's request from the circulating-bill pooling section 22 by driving the circulating-bill feeding-out mechanism 26.

S 33: Transfer the 10,000 yen bills fed out from the circulating-bill pooling section 22 through the bill dispensing route 27.

S 34: Count the number of the transferred 10,000 yen bills and check whether there are any abnormalities such as overlapped feeding at the bill dispensing route 27.

S 35: Discriminate whether any abnormality is detected. When some abnormality is detected, the procedure moves to step S 36. Otherwise, it moves to step S 38.

S 36: Transfer the bills which are the cause of the abnormality through the bill receiving route 19 with the distributing transfer section 87 connected to the bill receiving route 19 by the fourth fork 30.

S 37: Accommodate the bills in the received-bill box 25 through the accumulation wheel 24 for holding received bills with the bill receiving route 19 connected to the received-bill containing means 23 by the third fork 20. Thereafter, the procedure moves to step S 41.

S 38: When it is discriminated in step S 35 that no abnormality has been detected, transfer the bills through the common route 10 with the distributing transfer section 87 connected to the common route 10 by the fourth fork 30.

S 39: Transfer the bills through the accumulating route 12 with the common route 10 connected to the accumulating route 12 by the second fork 11.

S 40: Accumulate the bills transferred by the accumulating route 12 onto the supporting plate 17 of the bill delivering means 14.

S 41: Discriminate whether the dispensation of the 10,000 yen bills is completed in accordance with the user's dispensing order When it is discriminated that the dispensation has been completed, the procedure moves to step S 42.

S 42: Discriminate whether any 1,000 bills are designated in the user's request. When it is discriminated that 1,000 yen bills have been designated, the procedure moves to step S 43. Otherwise, it moves to step S 53.

S 43: Drive the dispensation bill feeding-out mechanism 29 of the dispensation bill containing means 28 and feed out 1,000 yen bills one by one from the dispensation bill box 79 in accordance with the user's request.

S 44: Transfer the 1,000 yen bills fed out from the dispensation bill box 79 through the bill dispensing route 27.

S 45: Count the number of the transferred 1,000 yen bills and check whether there are any abnormalities such as overlapped feeding at the bill dispensing route 27.

S 46: Discriminate whether any abnormality is detected. When some abnormality is detected, the procedure moves to step S 47. Otherwise, it moves to step S 49.

S 47: Transfer the bills which are the cause of the abnormality through the bill receiving route 19 with the distributing transfer section 87 connected to the bill receiving route 19.

S 48: Accommodate the bills in the received-bill box 25 through the accumulation wheel 24 for holding received bills with the bill receiving route 19 connected to the received-bill containing means 23 by the third fork 20.

S 49: When it is discriminated in step S 46 that no abnormality has been detected, transfer the bills through the common route 10 with the distributing transfer section 87 connected to the common route 10 by the fourth fork 30.

S 50: Transfer the bills through the accumulating route 12 with the common route 10 connected to the accumulating route 12 by the second fork 11.

S 51: Accumulate the bills transferred by the accumulating route 12 onto the supporting plate 17 of the bill delivering means 14.

S 52: Discriminate whether the dispensation of the 1,000 yen bills is completed in accordance with the user's dispensing order. When it is discriminated that the dispensation has been completed, the procedure moves to step S 53.

S 53: Drive the accumulating and transferring mechanism 16 of the bill delivering means 14 and move the supporting plate 17 and the scraping members 42.

S 54: Continue to drive the accumulating and transferring mechanism 16 until the movement of the supporting plate 17 and the scraping members 42 is completed (that is, until the supporting plate 17 arrives at a position above the bill receiving and dispensing mouth 4). When the movement is completed, the procedure advances to step S 55.

S 55: The bills stacked on the supporting plate 17 are dropped into the mouth 4 with the supporting plate 17 retracted by the spring 54 simultaneously with the completion of movement of the supporting plate 17 at step S 54. The mounting plate 44 is returned to its original position by reverse rotation of the driving motor for the accumulating and transferring mechanism 16.

S 56: Open the shutter 3 of the transaction port means 2.

S 57: Discriminate whether the user has taken out the bills accumulated in the mouth 4 of the transaction port means 2. When it is discriminated that the user has taken out the bills, the procedure moves to step S 58.

S 58: Close the shutter 3.

Thus, the whole cycle of the bill dispensing operation is completed.

Next, a bill charging operation and a bill recovering operation will be explained.

Bill Charging Operation

It is possible to charge the circulating-bill pooling section 22 with 10,000 yen bills from the outside of the machine body 1 with the door 68 opened and the circulating-bill pooling section 22 exposed at the front of the machine body 1. Alternatively, it is possible to charge 10,000 yen bills through the transaction port 2 in the manner of the bill receiving and bill-type separating mode described above. In such a case, it is also possible to count the number of the charged bills.

It is possible to charge the dispensation bill box 79 with 1,000 yen bills through the opening 84 thereof with the box 79 exposed to the outside of the machine body 1 by disengaging the lever 80 from the notches 82 and turning the box 79 counter-clockwise.

Bill Recovering Operation

It is possible to recover 10,000 yen bills from the machine body 1 by driving the circulating-bill feeding-out mechanism 26 of the circulating-bill pooling section 22 to feed out the 10,000 yen bills one by one from the section 22 and holding the bills in the received-bill box 25 with the bill dispensing route 27, the distributing transfer section 87 and the received-bill containing means 23 connected to each other by switching the third and fourth forks 20 and 30, and finally by opening the door 68 and separating the received-bill box 25 thereof.

The recovery of 1,000 yen bills can be carried out similarly to the 1,000 yen bill charging operation. Also, it is possible to carry out the 10,000 yen bill recovery operation similarly.

As can be understood from the explanations above, the bill receiving and dispensing machine of the present invention has the following effects.

(i) It is possible to eliminate the special bill pooling sections and the bill feeding-out mechanisms used in the machine of the prior art, since the machine of the present invention is so constructed that only one type of bills among all received bills is circulated through the circulating-bill pooling section for reuse as the bills for dispensation, that the dispensation bills other than the circulating bills are contained in the dispensation bill containing means, that the bills are contained in three sections, i.e. the circulating-bill pooling section, the received-bill containing means and the dispensation bill containing means, and that the received-bill containing means acts only to hold the bills and does not act to feed out the bills therefrom.

(ii) It is possible to effectively utilize the space within the machine body, since the machine of the present invention is so constructed that, in the bill receiving and bill-type separating mode, the bills after discrimination are transferred to the bill delivering means through the common route and are delivered to the dealing port means after having been temporarily pooled in the accumulation wheel for temporary pooling until the completion of discrimination and that the common route, the bill delivering means and the dealing port are commonly used even for bill dispensing operation with the bill dispensing route connected to the common route.

(iii) It is possible to minimize the height of the machine body, since the dispensation bill containing means is so arranged that it is inclined relative to the machine body.

(iv) From the reasons (i), (ii) and (iii) stated above, it is possible to realize a compact machine body and reduce noise because of the elimination of the bill pooling sections and the bill feeding-out mechanisms.

(v) It is possible to simplify the handing of the remaining amount of bills since the number of the bill pooling sections is minimized.

What we claim is:

1. A bill receiving and dispensing machine comprising:

bill discriminating means for discriminating bills;

transaction port means for respectively receiving bills from outside of the bill receiving and dispensing machine, bills discriminating by said bill discriminating means and fed from said bill discriminating means and bills to be dispensed, and temporarily storing the received bills, said transaction port means communicating with the outside of the bill receiving and dispensing machine and having a mechanism for feeding the bills received from outside of the bill receiving and dispensing machine;

said bill discriminating means discriminating whether the bills received from outside of the bill receiving and dispensing machine via said transaction port means are genuine and whether the denominations of the bills discriminated as genuine by said bill discriminating means and received from said transaction port means coincide with a predetermined bill denomination;

bill receiving route means for receiving bills fed from said bill discriminating means;

bill pooling means for receiving bills discriminated by said bill discriminating means as having the same denominations as the predetermined bill denomination and fed from said bill discriminating means via said bill receiving route means and temporarily pooling the bills therein, said bill pooling means being positioned elow said bill discriminating means and a center of the bill receiving and dispensing machine;

received bill containing means for receiving bills discriminated by said bill discriminating means as having denominations other than the predetermined bill denomination and fed from said bill discriminating means via said bill receiving route means and holding the bills therein, said receiving bill containing means being positioned just behind the back of a front door of the bill receiving and dispensing machine and in front of said bill pooling means;

said bill receiving route means connecting said bill discriminating means to said bill pooling means and said received bill containing means;

at least one dispensation bill containing means positioned below said bill pooling means and said received bill containing means, each of said at least one dispensation bill containing means holding bills having different denominations from each other and from the predetermined bill denomination and other than received through said transaction port means, said dispensation bill containing means being inclined toward said front door of the bill receiving and dispensing machine;

bill taking out means for taking out the bills from said bill pooling means and said dispensation bill containing means;

common route means for receiving bills from a plurality of route means;

bill dispensing route means for receiving the bills from said bill taking out means and feeding them to said common route means;

bill delivering means for feeding bills to said transaction port means;

said common route means connected to said bill discriminating means and said bill dispensing route means for feeding the bills received from said bill discriminating means and said bill dispensing route means to said bill delivering means; and said bill delivering means receiving the bills from said common route means and temporarily pooling the bills to feed the bills to said transaction port means.

* * * * *